United States Patent [19]

Gruber

[11] 4,051,830

[45] Oct. 4, 1977

[54] WHEEL DRESSING APPARATUS AND METHOD

[75] Inventor: Paul Gruber, Cincinnati, Ohio

[73] Assignee: Cincinnati Milacron Inc., Cincinnati, Ohio

[21] Appl. No.: 685,286

[22] Filed: May 11, 1976

[51] Int. Cl.[2] ..... B24B 53/00

[52] U.S. Cl. ..... 125/11 R; 51/325; 125/11 CD

[58] Field of Search ..... 125/11 CD, 11 R, 11 CW; 51/325

[56] References Cited

U.S. PATENT DOCUMENTS

| | | | |
|---|---|---|---|
| 3,033,187 | 5/1962 | Wespi | 125/11 CW |
| 3,267,620 | 8/1966 | Dayton | 51/163.1 |
| 3,305,974 | 2/1967 | Wilson | 125/11 B |
| 3,407,800 | 10/1968 | Hoare | 125/11 R |
| 3,637,190 | 1/1972 | Isaacson | 51/163.1 |
| 3,916,581 | 11/1975 | Messier | 125/11 CD |

*Primary Examiner*—Harold D. Whitehead

*Attorney, Agent, or Firm*—Thomas M. Farrell

[57] ABSTRACT

A method and apparatus for dressing adjacent faces on a grinding wheel. A single point dressing nib and a rotary dressing wheel are mounted to a common slide oriented with its slide axis parallel to a first face on the grinding wheel. As the slide is actuated, the nib is drawn across the first face of the grinding wheel, dressing the entire face. After the single point nib traverses the first face of the grinding wheel, the rotary dressing wheel is activated and brought into engagement with a second face on the grinding wheel, adjacent to the first face. A cam is provided on the base which carries the slide, so that a tracing stylus will follow the shape of the cam and transmit the cam profile to the dressing nib as it traverses its path. In this manner, therefore, an extremely accurate profile may be dressed on a first face of the grinding wheel, and a second, potentially wear-causing face may be dressed into the grinding wheel by a dressing wheel yet the rotary dressing wheel will not introduce vibrational inaccuracies into the first face.

10 Claims, 4 Drawing Figures

WHEEL DRESSING APPARATUS AND METHOD

BACKGROUND OF THE INVENTION

In grinding art, it is frequently necessary for machines which grind bearing races to grind adjacent faces on a given bearing race. One such common bearing race which is ground is the inner race, or "cone", of a tapered roller bearing set. When grinding the cone, it is desirable to grind the track on which the rollers roll, and the "rib", which is the adjacent face or shoulder to the track, against which the rollers end thrust. When grinding the rib and track of a roller bearing, the method of grinding is termed "conjugate grinding".

To be further familiarized with the conjugate grind process, it should be noted that the geometry of a roller bearing cone generally has an included angle between the rib and track of less than 90°. The exact angular relationship varies between manufacturers. It is further necessary when grinding the rib face, to establish a radius, or "break", at the outermost diameter of the rib face to eliminate what may be defined as a sharp edge and, again, the amount of break or radius at the outermost extremity of the rib face varies between manufacturers.

To shape the wheels necessary to perform the conjugate grinding operation, it is necessary to dress two adjacent faces on the grinding wheel; the longer face generally being referred to as the "track face", and the shorter, adjacent face is generally referred to as the "rib face". Further, the track face may often be dressed not entirely straight, but rather deviating from a straight line by some minute amount referred to as a "crown", so that any deformations in the track under load will be taken up by the crown amount against the roller and the rollers may bear on a straight face.

Many types of dressers are known in the prior art for dressing the adjacent faces on a conjugate grinding wheel, and by example of the more popular prior art devices, one uses only a single point diamond nib which is arranged to have its nib axis normal to the grinding wheel axis in such manner that as the nib is traversed with its slide in a direction generally parallel to the grinding wheel spindle, a tracing stylus will follow a stationary cam having the exact profile as is desired on the wheel faces, and the tracing stylus will impart motion to the nib to cause it to trace out the cam profile on the grinding wheel. One drawback to this type of operation is the fact that the diamond nib sees considerable wear, when changing directions: i.e. tracing the steep rib face and the radius, or "break" (which is a concave surface on the grinding wheel).

Further, as it is somewhat impractical to obtain generation of the radius required in the break, a special diamond nib is often used with the radius of the break formed on the diamond so that it may be merely plunged, or "gashed", into the break area. This involves using a costly diamond nib, which will not hold its form as it is progressively worn by the gashing action.

A second method of dressing the adjacent faces on a conjugate grinding wheel involves uses a truing device having two diamonds, each mounted to unique slides, which are parallel to the respective rib and track faces wherein each slide is actuated to dress a respective face. This results in a very complex truing mechanism having multiple slides and complex set up procedures.

A third, commonly used method of generating the faces on a conjugate grinding wheel involves using a rotry diamond wheel dresser which is plunged into the grinding wheel, wherein the diamond wheel dresser has an impression in its rotary surface which is the shape of the grinding wheel desired, and the diamond wheel is mounted with its axis parallel to the grinding wheel axis. This method of dressing the conjugate wheel faces is extremely expensive in that the diamond wheel must be tailor-made for each individual part, and any wear that is seen by the diamond wheel dresser may be ruinious to the accuracy of the wheel form desired. Further, since the diamond wheel is generally motorized, vibrational movements may be seen on the grinding wheel as chatter marks and while they may be immeasurable in some instances, their effect may be seen on the workpiece in the form of a chatter pattern.

Applicant has obviated the difficulties involved in the prior art devices by his invention of a unique wheel dressing unit, having a single slide, which utilizes a single point diamond nib to dress the track face on a grinding wheel, then employs an adjustably mounted rotary diamond dressing unit while continuing slide movement, to dress the rib face and corresponding break on the grinding wheel after the track face has been dressed.

SUMMARY OF THE INVENTION

A grinding wheel having adjacent faces for grinding the "rib" and "track" faces of a tapered roller bearing inner race, or "cone", is dressed by a grinding wheel dresser employing a base secured to the grinding machine, upon which base is mounted a single slide unit, having its slide axis substantially parallel to the "track" face.

The slide unit is comprised of a linear actuator for traversing the slide along its axis, and the slide carries a single point dressing nib flexibly secured to he slide in a holder which has a tracing stylus at an end of the holder so that as the slide is traversed along its axis, the tracing stylus of the nib holder will bear against a cam element which is fixed to the dresser base, and the flexibly secured nib holder may translate through a path transverse to the slide axis, corresponding to the face of the cam thereby dressing the path form into the "track", or first, face of the grinding wheel. The nib is traversed entirely across the first face of the grinding wheel, and, after completing its travel along the face, a rotary dressing unit secured to the slide in tandem with the nib, is then powered into rotation, and the dressing wheel profile is brought into engagement with the adjacent "rib", or second, face of the grinding wheel through continued slide movement. In this manner, therefore, the rib face and its corresponding "break" surface is generated on the wheel by the rotary dresser.

The slide is arranged with its slide axis substantially parallel to the first face of the grinding wheel at all times so that no matter how long the part may be, the track face is always dressed first by the slide-carried nib. The rib face is dressed by the rotary dresser unit tandemly attached to the slide. The rotary dresser unit is linearly adjustable to accomodate varying heights of ribs, relative to the track face, and further, is angularly adjustable to accomodate varying included angles between the adjacent faces on the wheel.

In the proposed method for dressing grinding wheels, the rotary dresser is actuated only after the single point dresser nib has traversed the entire first face of the grinding wheel, so that vibrational inaccuracies will not be introduced to the track face.

BRIEF DESCRIPTION OF THE DRAWINGS

The foregoing and other objects and features of the present invention will become more apparent upon a consideration of the following description taken in connection with the accompanying drawings wherein.

DESCRIPTION OF THE PREFERRED EMBODIMENT

Figure 1:
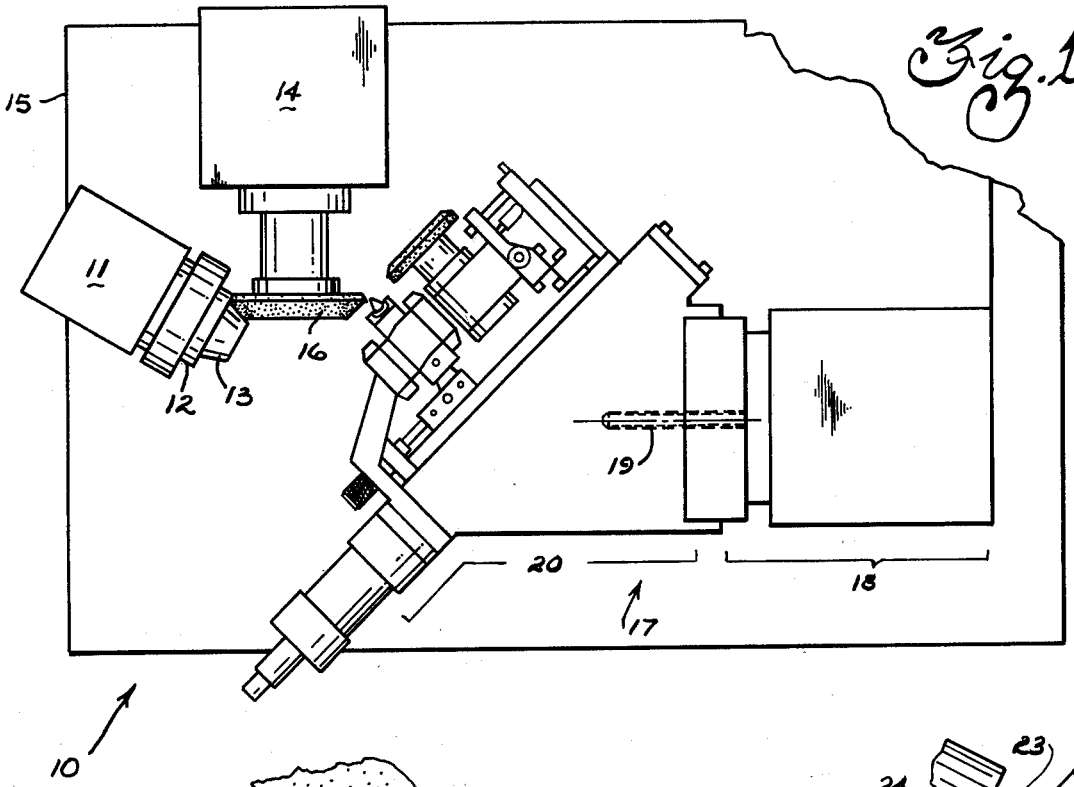
FIG. 1 is a plan view of a grinding machine illustrating workpiece, grinding wheel, and wheel dressing unit.

Turning now to the drawings and particularly to FIG. 1 thereof, there is shown a grinding machine 10 having a headstock 11 and means 12 for supporting and driving the rotatable workpiece 13. A wheelhead 14 is carried on the machine base 15 and a grinding wheel 16 is rotatably carried in the wheelhead 14 and is moved into contact with the workpiece 13 by movement of the wheelhead 14 on the base 15. A wheel dressing unit 17 is carried with the wheelhead 14 on the base 15, and the dresser unit 17 is comprised of two sections: a compensator section 18, having a rotatable screw 19, which threadably engages a dresser section 20. The compensator section 18 is fixed relative to the wheelhead 14 and the dresser section 20 is fixed relative to the wheelhead 14 and the dresser section 20 is fixed relative to the grinding wheel 16 when dressing. However, to advance the dresser section 20 relative to the wheel 16 to accommodate changes in wheel diameter, the compensator section 18 is actuated thereby moving the dresser section 20 on the compensator screw 19 relative to the grinding wheel 16, when not dressing.

Figure 2:
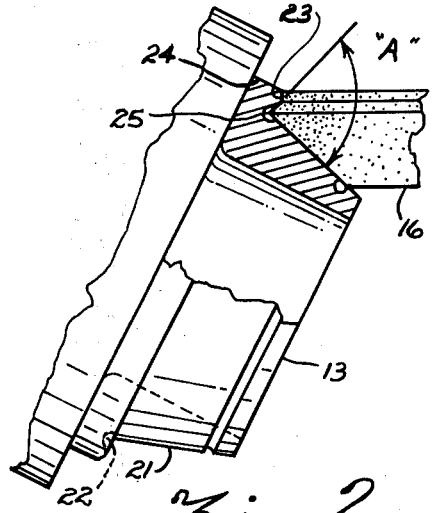
FIG. 2 is an enlarged plan view of the workpiece of FIG. 1 in contact with a grinding wheel.

FIG. 2 depicts an enlarged partial plan section through the workpiece 13 of FIG. 1, with the grinding wheel 16 in contact. For purposes of illustration, the workpiece 13 chosen to be represented is the inner race, or "cone", of a tapered roller bearing. The workpiece 13 has a conical surface 21 to be ground as the workpiece 13 is rotated, referred to as the "track" of the bearing. An adjacent transverse shoulder surface 22 is also a ground surface, referred to as the "rib face" of the bearing.

Occasionally, the track and rib faces 21, 22 are ground independently on individual machine setups with appropriate wheel shapes to accomplish the purposes referred to as "discrete grinding".

In the case shown in FIG. 2, it is desired to grind the rib and track faces 22, 21 simultaneously which is referred to in the art as "conjugate grinding" (grinding of two adjacent faces). Further, at the outer edge of the rib face 22, it is desired to grind a small break 23 (which may be straight or curved, depending on the manufacturer) to remove the sharp edge which could possibly result from the intersection of the rib face 22 and the outside diameter 24.

The included angle "A" between the rib and track faces 22, 21 is most generally less than 90° and varies with manufacturer and with size of bearings. The included angle "A" of the two face, 21 22, together with the outside diameter 24, tends to limit the wheel size and the angle of approach of the wheel to the workpiece 13. The juncture of the rib and track faces 22, 21 on the grinding wheel 16 is referred to as the wheel apex 25 and is the outside diameter of the grinding wheel 16.

Figure 3:
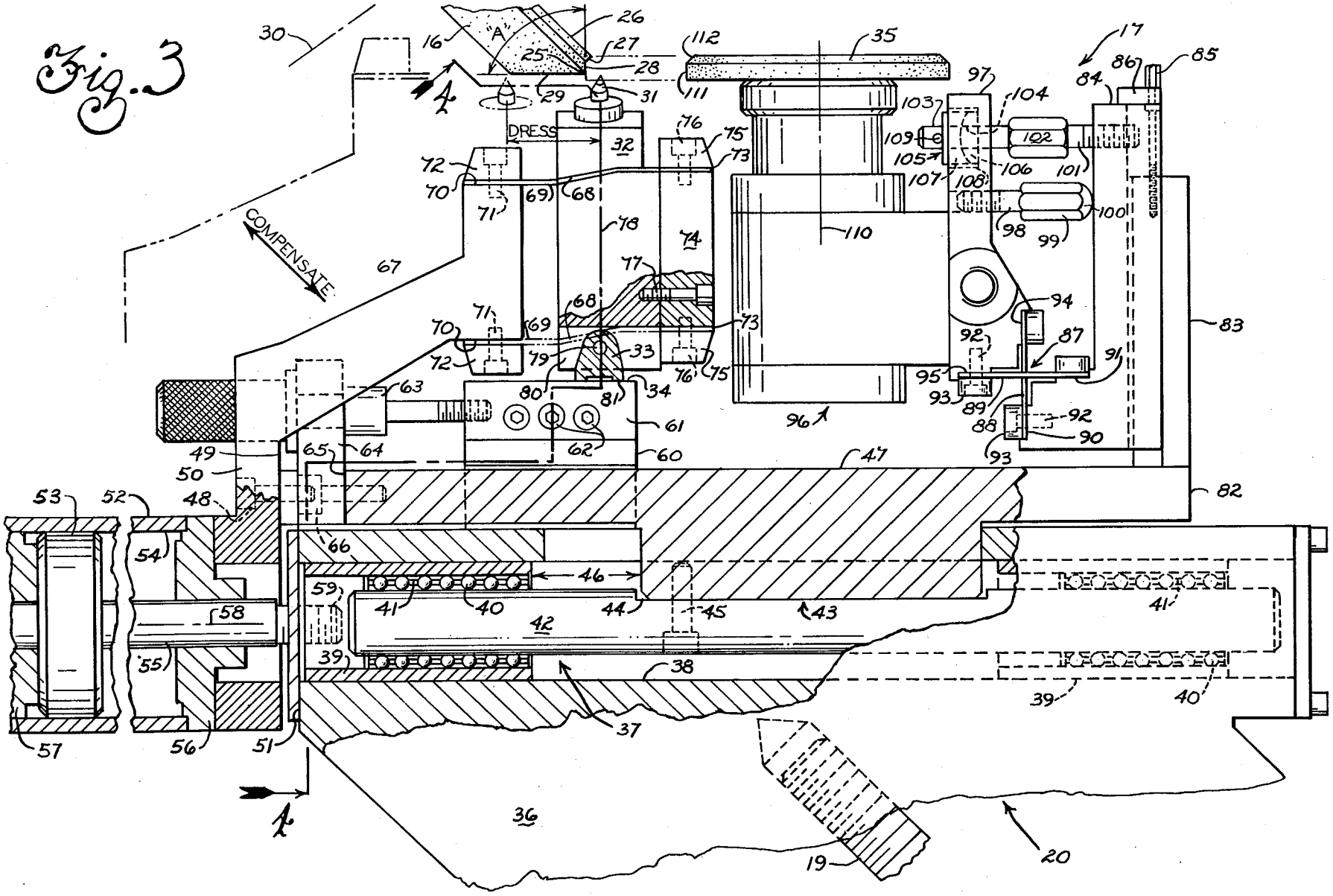
FIG. 3 is a plan section taken through the dressing unit of FIG. 1.

Turning now to FIG. 3, the plan section taken through the wheel dressing unit 17 illustrates the relationship of the unit 17 to the grinding wheel 16. The grinding wheel 16 has a back face 26, break surface 27, rib face 28 and track face 29 and the rib and track surfaces 28, 29 meet at the wheel apex 25, which is the outer diameter of the grinding wheel 16. The track face 29 is most generally the principal, or "main" face of the grinding wheel 16 and is conical about the wheel axis 30 with its base at the apex 25 of the wheel 16. The rib face 28 is generally a "secondary" face on the grinding wheel when compared to the track face 29, and is also conical about the wheel axis 30, oppositely extending, with its base at the apex 25 of the wheel 16 as well.

It is felt that an extremely accurate track face 29 can be dressed on a grinding wheel 16 by moving a single point dressing nib 31 across the surface 29 while a nib holder 32 and connected stylus 33 traces out the shape of a rigid cam surface 34. In this way, the cam surface 34 is reproduced on the wheel face 29 with substantially less vibrational inaccuracies than are encountered with a dressing wheel. However, he dressing of the rib, or second face 28 of the grinding wheel 16 is difficult to do with the same single point dressing nib 31 in that the direction of movement must be changed substantially and the break surface 27 of the grinding wheel 16 causes great wear on the gashing nib 31. The relatively short rib surface 28 and break surface 27 can be dressed economically with a rotary dressing wheel 35 since the rib face 28 does not require the accuracy of form required on the track face 29 and vibrational inaccuracies will not cause as detrimental an effect.

The wheel dressing unit 17 depicted shows the dresser section 20 which is threadably secured to the compensator screw 19, wherein the compensator screw 19 is oriented substantially parallel to the back face 26 of the grinding wheel 16, i.e., substantially normal to the grinding wheel axis 30. The dresser section 20 comprises a housing 36 which is compensatingly slidable relative to the grinding wheel 16 when not dressing, and the housing 36 has a way system 37 comprising in part, a pair of bores 38 through the housing 36 (further depicted in FIG. 4) which are substantially parallel to the main face 28 of the grinding wheel 16, and each bore 38 contains a set of bushings 39 to provide a hard wear surface for rolling ball elements 40 which are entrapped in ball cages 41. A slide bar 42 is shown extending through the disposed ball elements 40, forming a support for a movable carrier bracket 43. The bar 42 is cylindrical and has a center portion 44 relieved and adapted to the carrier bracket 43. Screws 45 are provided through the bar 42 to secure the bar 42 to the bracket 43. In this fashion, therefore, the carrier bracket 43 may be traversed as the bars 42 move on the rolling ball elements 40.

The carrier bracket extends through a clearance opening 46 in the housing 36 and has a plate-like portion 47 outside the housing 36. The plate portion 47 is attached by screws 48 at one end 49 to an end bracket 50 which extends transverse to the plate portion 47 along the side 51 of the housing 36. The end bracket 50 is affixed to a cylinder 52 which has a central, coaxial, piston 53 located within the cylinder bore 54. The piston rod 55 extends through caps 56, 57 at each end of the cylinder 52 and is oriented with its axis 58 parallel to the slide bar 42. The end 59 of the piston rod 55 is threadably engaged with the side 51 of the housing 36 so that as fluid is introduced into the cylinder 52, the cylinder will move relative to the piston 53 and transport the carrier bracket 43 to and fro.

A cam bracket 60 is affixed to the housing 36, extending beyond the plate portion 47 of the carrier bracket 43 and a rigid cam block 61 is held to the cam bracket 60 by screws 62.

A cam adjusting screw 63 is rotatably journalled in a block 64 located in a recess 65 in the plate portion 47 of the carrier bracket 43 and secured by screws 66. The screw 63 is threadably engaged with the cam block 61 to provide fine adjustment of the block 61.

The end bracket 50 has an outboard arm 67, which extends over the bracket 43, in front of the cam block 61. A pair of leaf springs 68 are affixed by one end 69 to parallel faces 70 on the outboard arm 67, and are clamped to the arm by screws 71 and clamp blocks 72. The leaf springs 68 extend parallel to the bar 42 (unstressed) from the outboard arm 67 across and in front of the cam block 61, and the opposite ends 73 of the leaf springs 68 are affixed to a nib holder plate 74 by blocks 75 and screws 76. The plate 74 is affixed to the nib holder 32 by screws 77.

The dresser nib holder 32 is a generally-rectangular block oriented with its longitudinal axis 78 normal to the cam block surface 34, and the nib holder 32 is fitted with a dressing nib 31 at the end nearest the grinding wheel face 29, and further, the nib holder 32 is fitted with a stylus 33 at the end nearest the cam block 61. The stylus 33 is pivotally carried on a pin 79 in a slot 80 in the nib holder 32 and the face 81 of the stylus 33 which bears on the cam block 61 is relieved so the stylus 33 may track closely with the cam block surface 34.

The dimensions of the arm 67 and nib holder are 32 such that when the leaf springs 68 are clamped and the nib holder stylus 33 is brought to bear on a cam block 61, the springs will be deflected to a position (shown) which causes the nib holder 32 to be preloaded against the cam block 61. Thereafter, as the nib holder 32 is traversed across a profile on the cam block surface 34, the stylus 33 will remain in contact with the surface 34. Thus, the springs 68 may carry the nib 31 along a path transverse to the main face 29 of the wheel 16.

Here it should be noted that occasionally it may be desirable to dress a curvature or "crown" on the main face of the grinding wheel (or other profile), and this curvature will be provided on the cam block 61. It can be seen then that as the cylinder 52 is actuated, the outboard arm 67 will move with the bracket 43 and the dresser nib and its holder will move along a pathway which dresses the shape of the cam surface 34 into the main surface 29 of the grinding wheel 16.

The rear end 82 of the plate portion 47 of the bracket 43 is fitted with a cantilevered transverse slideway 83. A dressing wheel slide 84 is adjustably carried on the transverse way 83 and movable thereon by an adjusting screw 85 which is rotatably journalled in a block 86 on the slide, and the screw 85 is threadably engaged with the slideway 83. The dressing wheel slide 84 is fitted with a flexural pivot joint 87, comprised of crossed leaf springs 88, 89 which are affixed by one end respectively to transverse faces 90, 91 on the dressing wheel slide 84 by screws 92 and blocks 93, and the opposite ends of the crossed leaf springs 88, 89 are affixed to transverse machined surfaces 94, 95 on the dressing wheel housing 96 by screws 92 and blocks 93. In this manner, the dressing wheel housing 96 is pivotally carried on the flexural joint 87 relative to the dressing wheel slide 84, so that the included angle "A" of the wheel faces 28, 29 may be varied by pivotally adjusting the dressing wheel housing 96 relative to the dressing wheel slide 84. The foot 97 of the dressing wheel housing 96, which extends from the flexural pivot joint 87, has a first adjusting screw 98 which is threadably engaged in the foot 97, having a hexagon head 99 with a ball face 100 thereon which bears against the dressing wheel slide 84 so that the foot 97 may be pushed away from the slide 84 by rotation of the adjusting screw 98. A second adjusting screw 101 is threadably engaged in the wheel dressing slide 84 proximate to the first adjusting screw 98. The second adjusting screw 101 has a central, hexagon-shaped, cross-section 102 and an end 103 extending through the bore 104 of a ball-face washer set 105 comprising convex and concave washer elements 106, 107 which are seated in a clearance counterbore 108 in the foot 97. The screw end 103 extending through the washer set 105 has a transverse pin 109 so that as the 101 screw is wound into the wheel dresser slide 84. The pin 109 will pull on the ball washer set 105 thus preloading the foot 97 and the first adjusting screw 98 against the slide 84. Thus the two adjusting screws 98, 101 work against one another to push and pull the foot 97 into a preloaded angularly adjusted position relative to the flexural pivot joint 87.

The dressing wheel housing 96 carries a rotatable dressing wheel 35 on an axis 110 which is transverse to the main wheel face 29, and the dressing wheel 35 has a diameter 111 which dressingly establishes the second wheel face 28. A break surface 112 is further provided on the dressing wheel 35 to establish the break surface 27 on the grinding wheel 16.

In operation, the carrier bracket 43 is moved from a home position (shown solid), where the dressing nib 31 is proximate to the apex 25 of the grinding wheel 16, whereupon the dressing nib 31 contacts the grinding wheel 16 and dresses the entire main face 29 of the wheel 16. The dressing wheel 35 is carried in tandem with the dressing nib 31 as shown, and the wheel 35 is not rotary actuated while the nib 31 is dressing the main face 29. After the entire main face 29 has been dressed, the dressing wheel 35, now proximate to the grinding wheel apex 25 (shown in phantom), is rotatably actuated and, by continued slide movement, is brought into contact with the grinding wheel 16, thus dressing the second, adjacent, face, 28 and the break surface 27 of the wheel 16.

A wide variety of wheels 16 can be dressed with the combination nib 31 and dressing wheel 35 as depicted, where the surface lengths and included angles vary. The grinding wheel form which is shaped by the single slide movement may be transposed in a direction parallel to the back face 26 of the grinding wheel 16 by advancement of the dresser section 20 on the compensator screw 19.

Figure 4:
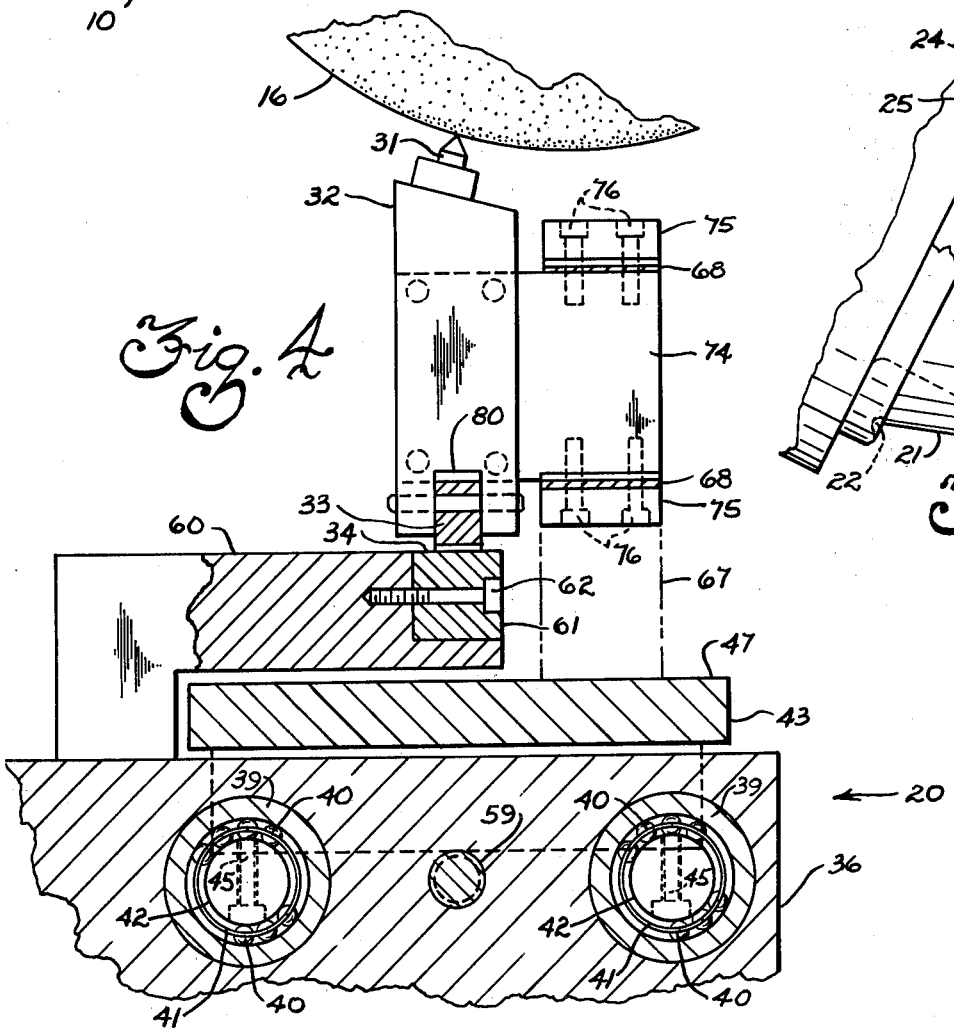
FIG. 4 is an elevational section through the wheel dressing unit, taken along the line 4—4 of FIG. 3.

The view depicted in FIG. 4, is an elevational section through the dresser section 20, illustrating the dresser housing 36 with its cam bracket 60 extending in front of the plate portion 47 of the carrier bracket 43. The cam block 61 is shown secured in position on the cam bracket 60 by screws 62 and the dresser nib 31 is shown contacting the wheel 16. The nib 31 is supported by the dresser nib holder 32, and the dresser stylus 33 is shown in its slot 80, bearing against the cam surface 34 of the cam block 61. The leaf springs 68 are shown secured to the nib holder plate 74 by blocks 75 and screws 76, and the outboard arm 67 is shown in phantom, extending from the carrier brackets 43. The slide bars 42 are carried by their ball elements 40 and the bars 42 are affixed to the carrier brackets 43 by screws 45. The piston rod end 59 is threadably engaged with the housing 36 at a point between the support bars 42.

What is claimed is:

1. In a grinding machine, having a rotatable grinding wheel with a nib-dressed main face and a wheel-dressed second face intersecting the main face, an improved wheel dressing apparatus for conditioning both the main and second faces in a one-direction stroke, comprising in combination:

a. a housing, fixed with respect to said wheel when dressing;

b. a carrier bracket, movable on said housing with respect to said grinding wheel;

c. a way system upon said housing to provide carrier bracket movement generally parallel to the nib-dressed main face;

d. a dressing nib carried by said carrier bracket so as to dress said main face as said bracket is moved parallel to said main face; and e. a dressing wheel, rotatable on an axis transverse to said main face, and carried in tandem with said nib on said bracket so as to dress the second face through continued parallel movement of said bracket.

2. The dressing apparatus of claim 1, further comprising compensator means to move said housing relative to said grinding wheel when not dressing.

3. The dressing apparatus of claim 1, further comprising nib holder means adapted to move said nib relative to said carrier along an axis transverse to said main face.

4. The dressing apparatus of claim 1, wherein said dressing wheel may be powered into rotation at predetermined bracket positions.

5. The dressing apparatus of claim 1, further comprising means for angular adjustment of said dressing wheel relative to said carrier bracket so as to vary the included angle between the intersection of said main and second faces.

6. The dressing apparatus of claim 1, further comprising means to linearly position said dressing wheel relative to said carrier bracket so as to vary the dressing length of said second face.

7. In a grinding machine, having a rotatable grinding wheel with a main face and a second face intersecting the main face, an improved wheel dressing apparatus for conditioning both the main and second faces comprising in combination:

a. a housing, fixed with respect to said grinding wheel when dressing;

b. a carrier bracket, movable on said housing with respect to said grinding wheel;

c. a way system on said housing oriented to move said bracket along a pathway generally parallel to said main face;

d. a dressing nib, carried by said carrier bracket to dress said main face;

e. a dressing wheel, rotatably carried in a wheel housing on an axis transverse to said main face, wherein said dressing wheel and wheel housing are carried in tandem with said nib on said bracket along said pathway to dress said second face;

f. flexible leaf springs, affixed at one end to a nib holder and affixed at the opposite end to said carrier bracket to support and maintain nib attitude while providing a translational axis for relative movement of said nib with respect to said carrier bracket when dressing; and g. crossed leaf springs establishing a flexural pivot joint, affixed at one end relative to said wheel housing and affixed at the opposite end relative to said carrier bracket, to vary the included angle between the intersection of said main and second faces.

8. In a grinding machine, having a rotatable grinding wheel with a main face and a second face intersecting the main face, an improved wheel dressing apparatus for condition both the main and second faces comprising in combination:

a. a housing, fixed with respect to said grinding wheel when dressing;

b. a carrier bracket, movable on said housing with respect to said grinding wheel;

c. a way system on said housing oriented to move said bracket along a pathway generally parallel to said main face;

d. a dressing nib, carried by said carrier bracket to dress said main face;

e. a dressing wheel rotatably carried in a wheel housing on an axis transverse to said main face, wherein said dressing wheel and wheel housing are carried in tandem with said nib on said bracket along said pathway to dress said second face;

f. flexible leaf springs, affixed at one end to a nib holder and affixed at the opposite end to said carrier bracket to support and maintain nib attitude while providing a translational axis for relative movement of said nib with respect to said carrier when dressing; and g. a dressing wheel slide affixed to said wheel housing and adjustably carried on a way system on said carrier bracket so as to linearly position said dressing wheel relative to said carrier bracket to vary the dressing length of said second face.

9. A method for dressing a nib-dressed main face and a wheel-dressed second face of a grinding wheel in a grinding machine, comprising the following steps:

a. rotating the grinding wheel;

b. carrying a dressing nib and a dressing wheel on a common carrier bracket;

c. moving said bracket in a direction substantially parallel to the main face;

d. dressing the entire main surface with said nib as said bracket is moved in said parallel direction;

e. commencing rotation of said dressing wheel after said main surface is dressed; and f. continuing movement of said bracket in said parallel direction to dressingly engage the rotating dressing wheel with the second face.

10. The method of claim 9, wherein step (d) further includes rotating said dressing wheel about an axis transverse to said direction of parallel movement.

* * * * *